US005383006A

United States Patent [19]

Castelli

[11] Patent Number: 5,383,006

[45] Date of Patent: Jan. 17, 1995

[54] COMPLIANT EDGE GUIDE BELT LOOPS

[75] Inventor: Vittorio R. Castelli, Yorktown Heights, N.Y.

[73] Assignee: Xerox Corporation, Stamford, Conn.

[21] Appl. No.: 160,647

[22] Filed: Dec. 2, 1993

[51] Int. Cl.[6] ..... G03G 15/00

[52] U.S. Cl. ..... 355/212; 198/843

[58] Field of Search ..... 355/212, 282, 285; 226/15-17; 198/840, 843

[56] References Cited

U.S. PATENT DOCUMENTS

| | | | |
|---|---|---|---|
| 3,518,739 | 7/1970 | Butler | 29/123 |
| 3,818,391 | 6/1974 | Jordon et al. | 226/21 X |
| 3,913,729 | 10/1975 | Andrews | 226/23 X |
| 4,027,966 | 6/1977 | Jordan . | |
| 4,061,222 | 12/1977 | Rushing | 198/807 |
| 4,170,175 | 10/1979 | Conlon, Jr. | 101/1 |
| 4,174,171 | 11/1979 | Hamaker et al. . | |
| 4,221,480 | 9/1980 | Spehrley . | |
| 4,344,693 | 8/1982 | Hamaker . | |
| 4,367,031 | 1/1983 | Hamaker . | |
| 4,397,538 | 8/1983 | Castelli et al. . | |
| 4,429,985 | 2/1984 | Yokota . | |
| 4,561,757 | 12/1985 | Salomon et al. . | |
| 4,572,417 | 2/1986 | Joseph et al. | 226/20 |
| 4,961,089 | 10/1990 | Jamzadeh | 355/207 |
| 5,070,365 | 12/1991 | Agarwal | 355/212 |
| 5,078,263 | 1/1992 | Thompson et al. | 198/807 |
| 5,244,138 | 9/1993 | Blanding | 226/174 |

*Primary Examiner*—R. L. Moses

*Attorney, Agent, or Firm*—Kevin R. Kepner

[57] ABSTRACT

An apparatus for guiding a moving belt, particularly in an electrophotographic printing machine of the type having an endless photoreceptor belt supported by a plurality of rolls and arranged to move in a predetermined path through a plurality of processing stations disposed therealong. The belt being of the type which is supported by a plurality of rolls. A compliant belt guide is positioned at each end of a tensioning roll. The guide is biased so as to absorb a portion of the force exerted on it by the moving belt but to maintain a minimal belt walk in a direction transverse to the predetermined path.

14 Claims, 2 Drawing Sheets

COMPLIANT EDGE GUIDE BELT LOOPS

Figure 1:
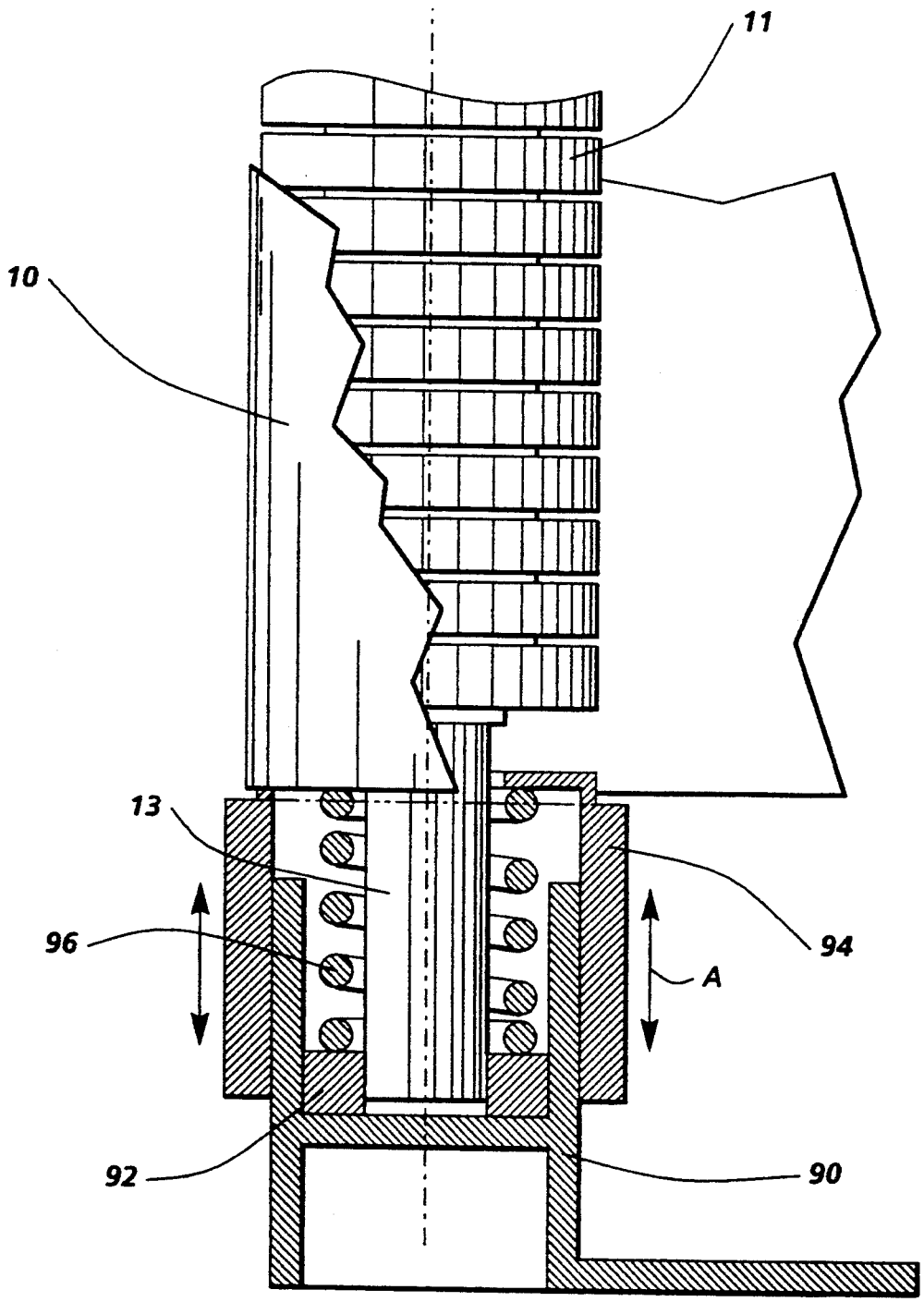

This invention relates generally to a system belt steering guide, and more particularly concerns a compliant edge guide to maintain proper belt tracking characteristics without damaging the belt.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

Many commercial applications of the above process employ a photoconductive member in the form of a belt which is supported about a predetermined path past a plurality of processing stations to ultimately form a reproduced image on copy paper. The location of the latent image recorded on the photoconductive belt must be precisely defined in order to have the various processing stations acting thereon optimize copy quality. To this end, it is critical that the lateral alignment of the photoconductive belt be controlled within prescribed tolerances. Only in this manner will a photoconductive belt move through a predetermined path so that the processing stations disposed thereabout will be located precisely relative to the latent image recorded thereon. Lateral movement of the photoconductive belt is particularly a problem in connection with color copiers where the precise tracking of the belt is mandatory for acceptable copy quality.

In belt-based color image output terminals the lateral registration of the color separations is adversely affected by lateral motion of the belt. This is true in single pass as well as recirculating engines. In belt modules where belt guidance is achieved by means of an edge guide, lateral motion of the belt can result from the lack of straightness of the belt edge. In turn, the lack of edge straightness results from imprecision in the slitting during manufacturing, from a step at the seam produced by imprecision in the seaming operation, and from belt conicity produced by a difference in the length of the two belt edges before seaming.

The mechanism by which the lateral belt motion occurs is approximately the following: Misalignments in the belt module and belt conicity cause the belt to "walk" toward one side. When the high side of the belt edge rides against the edge guide, the belt is displaced laterally by either bending, or by deflecting the surface of some of the rolls, or by slipping over some of the rolls. When the edge guide rides along the low portion of the belt edge, the belt moves back by a combination of elastic restoration and walk. In this part of the cycle the belt can also come out of contact with the edge guide. Therefore, the amplitude of the lateral belt motion is a complicated function of the geometry and mechanical properties of all components involved and it is somewhat smaller but on the same order as the amplitude of the edge deviation from straightness.

When considering control of the lateral movement of the belt, it is well known that if the belt were perfectly constructed and entrained about perfectly cylindrical rollers mounted and secured in an exactly parallel relationship with one another, there would be no lateral movement of the belt. In actual practice, however, this is not feasible. Due to the imperfections in the system's geometry, the belt velocity vector is not normal to the roller axis of rotation, and the belt will move laterally relative to a roller until reaching a kinematically stable position.

Existing methods of controlling the lateral movement of a belt comprise servo systems, crowned rollers and flanged rollers. Servo systems use steering rollers to maintain lateral control of the belt. While they generally apply less stress to the sides of the belt than do crowned rollers and flanged rollers, servo systems are frequently rather complex, costly and require a large space within the machine. Crowned and flanged rollers while being inexpensive, frequently produce high local stresses resulting in damage to the edges of the belt.

Accordingly, it is desirable to develop a belt steering system that is relatively simple and compact yet avoids the high localized stresses of crowned and flanged rollers.

The following disclosures may be relevant to various aspects of the present invention:

U.S. Pat. No. 4,061,222
Inventor: Rushing
Issue Date: Dec. 6, 1977
U.S. Pat. No. 4,572,417
Inventor: Joseph et al.
Issue Date: Feb. 25, 1986
U.S. Pat. No. 4,170,175
Inventor: Conlon, Jr.
Issue Date: Oct. 9, 1979
U.S. Pat. No. 4,174,171
Inventor: Hamaker et al.
Issue Date: Nov. 13, 1979
U.S. Pat. No. 4,344,693
Inventor: Hamaker
Issue Date: Aug. 17, 1982
U.S. Pat. No. 4,961,089
Inventor: Jamzadeh
Issue Date: Oct. 2, 1990
U.S. Pat. No. 5,078,263
Inventor: Thompson et al.
Issue Date: Jan. 7, 1992

The relevant portions of the foregoing disclosures may be briefly summarized as follows:

U.S. Pat. No. 4,061,222 to Rushing discloses an apparatus for tracking an endless belt along an endless path by a tiltable belt steering roller whose position is continually adjusted so that the belt is maintained at a stable equilibrium position despite changes in the belt shape. The adjustment is determined by control circuitry which produces signals representative of lateral belt edge position, a desired belt edge position, and either a steering roller position or an instantaneous lateral belt deviation rate to produce a control signal which is applied to a gear motor to control the tilt angle of the steering belt roller. This apparatus utilizes the absolute control method.

U.S. Pat. No. 4,572,417 to Joseph et al. discloses an apparatus for controlling lateral, cross track alignment of a web moving along a path to minimize lateral deviation between successive discrete areas of the web. A steering roller supports the web for movement along the path and is rotatable about an axis perpendicular to a plane of the span of the web approaching the steering roller.

U.S. Pat. No. 4,170,175 to Conlon, Jr. discloses a system for tracking an endless belt which automatically compensates for creep of the belt. The belt is supported by four rollers. A first is a drive roller, a second and third are idler rollers, and a fourth roller is an idler roller with flared ends. The flared roller provides passive tracking without electronic or active feedback. One of the idler rollers is spring loaded such that when an edge of the belt creeps up on one of the flared ends of the fourth roller, that side of the spring loaded roller is caused to tilt due to increased belt stiffness on that side. This positions the belt laterally toward a central position.

U.S. Pat. No. 4,174,171 to Hamaker et ano. disclose an apparatus for controlling the lateral alignment of a moving photoconductive belt. A resilient support constrains lateral movement of the belt causing a moment to be applied to a pivotably mounted steering post. As a result, the steering post pivots in a direction to restore the belt along a predetermined path. This apparatus is passive and provides no active electronic feedback.

U.S. Pat. No. 4,344,693 to Hamaker disclose an apparatus for controlling the lateral alignment of a moving photoconductive belt. Lateral movement of the belt causes a frictional force to be applied to the belt support. The frictional force tilts the belt support to restore the belt to the predetermined path of movement. This apparatus is passive and provides no active electronic feedback.

U.S. Pat. No. 4,961,089 to Jamzadeh discloses a method and apparatus for controlling lateral movement of a web along an endless path. The lateral position of the web is monitored and a determination is made by a control unit if the web is within predetermined limits such that a copying operation can be completed while the web is still properly tracking. If the web is not tracking properly, or if it is predicted that the web will track beyond its predetermined lateral limits within a copying operation, a correcting step is taken prior to the copying operation. The correcting step determines a tilt angle for a steering roller. Upon completion of the correcting step, the apparatus returns to a monitoring capacity and does not provide corrective measures until the web is beyond or is predicted to go beyond the predetermined limits during a subsequent copying operation. This insures that copying operations have proper registration and do not include corrective steps during the copying operation which might interfere with the registration. This apparatus uses an absolute scheme to determine corrective action.

U.S. Pat. No. 5,078,263 to Thompson et al. discloses an active steering method that introduces corrective skew through a small rotation about the "soft-axis" of one or more idler rolls. The skew is introduced by an external connection to a servo-motor to alter the angle at which the web enters or leaves the roll to cause the web to walk along the roll.

In accordance with one aspect of the present invention, there is provided an apparatus for controlling a web moving along a predetermined path. The apparatus includes a member rotatably supporting the web and an edge guide adjacent one end of said support member, said edge guide positioned to contact an edge of the web so as to maintain the web along the predetermined path. A biasing device for resiliently urging said edge guide into contact with the edge of the web, said biasing device absorbing a portion of a force exerted on said edge guide by the web to minimize movement of the web in a direction normal to the predetermined path is also provided.

Pursuant to another aspect of the present invention, there is provided an electrophotographic printing machine of the type having an endless photoreceptor belt supported by a plurality of rolls and arranged to move in a predetermined path through a plurality of processing stations disposed therealong. The improvement includes a member rotatably supporting the belt and an edge guide adjacent one end of said support member, said edge guide positioned to contact an edge of the belt so as to maintain the belt along the predetermined path A biasing device for resiliently urging said edge guide into contact with the edge of the belt, said biasing device absorbing a portion of a force exerted on said edge guide by the belt to minimize movement of the belt in a direction normal to the predetermined path is also provided.

Figure 2:
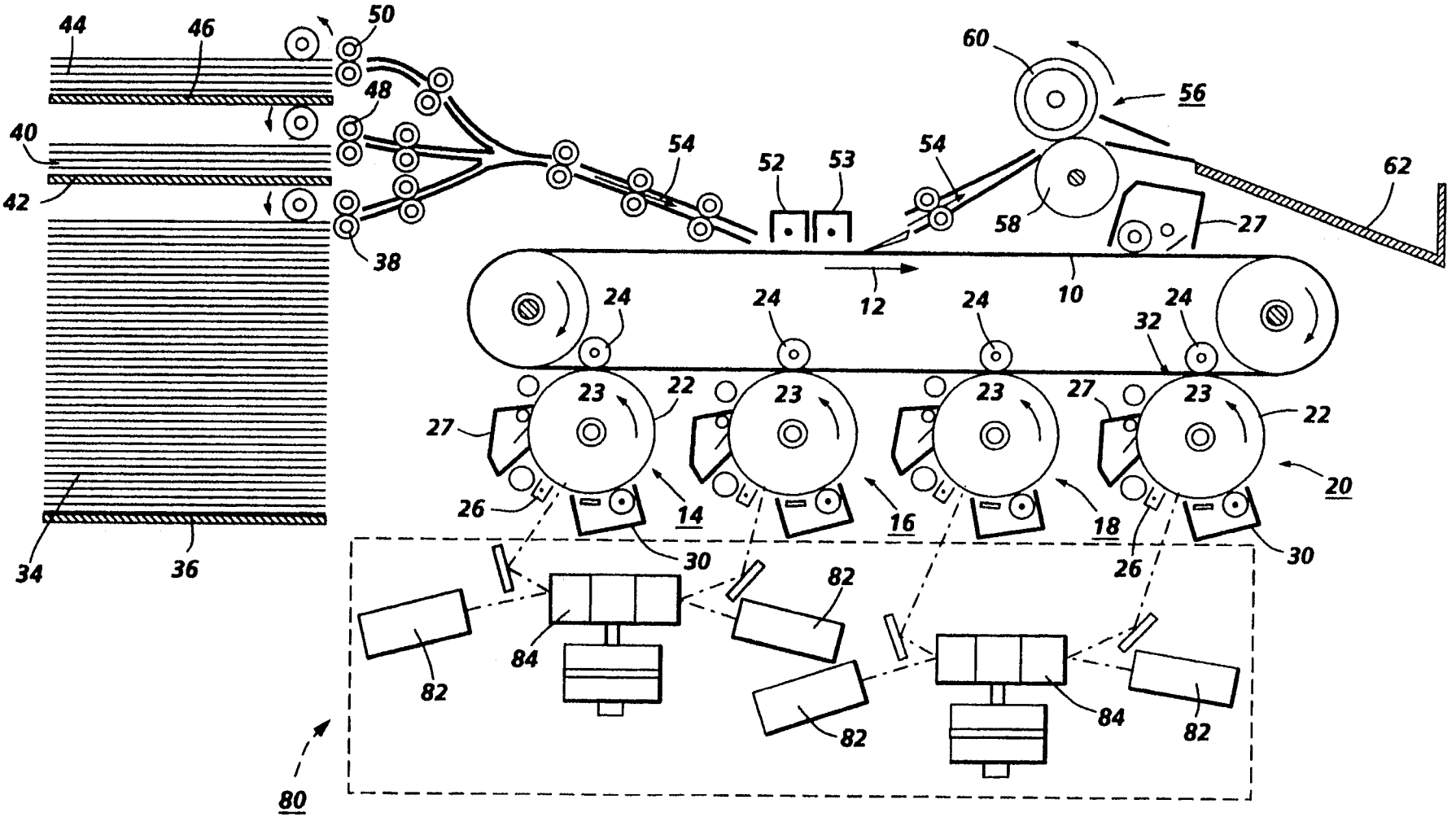

Other features of the present invention will become apparent as the following description proceeds and upon reference to the drawings, in which:

FIG. 1 is a partial sectional plan view of the compliant edge guide system; and FIG. 2 is a schematic elevational view of a multicolor single pass electrophotographic printing machine incorporating the FIG. 1 system therein.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like reference numerals have been used throughout to identify identical elements. Referring now to FIG. 2, an intermediate belt designated generally by the reference numeral 10 is mounted rotatably on the machine frame. Belt 10 rotates in the direction of arrow 12. Four imaging reproducing stations indicated generally by the reference numerals 14, 16, 18 and 20 are positioned about the periphery of the belt 10. Each image reproducing station is substantially identical to one another. The only distinctions between the image reproducing stations is their position and the color of the developer material employed therein. For example, image reproducing station 14 uses a black developer material, while stations 16, 18 and 20 use yellow, magenta and cyan colored developer material. Inasmuch as stations 14, 16, 18 and 20 are similar, only station 20 will be described in detail.

At station 20, a drum 22 having a photoconductive surface deposited on a conductive substrate rotates in direction of arrow 23. Preferably, the photoconductive surface is made from a selenium alloy with the conductive substrate being made from an electronically grounded aluminum alloy. Other suitable photoconductive surfaces and conductive substrates may also be employed. Drum 22 rotates in the direction of arrow 23 to advance successive portions of the photoconductive surface through the various processing stations disposed about the path of movement thereof.

Initially, a portion of the photoconductive surface of drum 22 passes beneath a corona generating device 26. Corona generating device 26 charges the photoconductive surface of the drum 22 to a relatively high, substantially uniform potential.

Next, the charged portion of the photoconductive surface is advanced through the imaging station. At the imaging station, an imaging unit indicated generally by the reference numeral 80, records an electrostatic latent image on the photoconductive surface of the drum 22. Imaging unit 80 includes a raster output scanner. The raster output scanner lays out the electrostatic latent image in a series of horizontal scan lines with each line having a specified number of pixels per inch. Preferably, the raster output scanner employs a laser 82 which generates a modulated beam of light rays which are scanned across the drum 22 by rotating a polygon mirror 84. Alternatively, the raster output scanner may use light emitting diode array write bars. In this way, an electrostatic latent image is recorded on the photoconductive surface of the drum 22.

Next, a developer unit indicated generally by the reference numeral 30 develops the electrostatic latent image with a cyan colored developer material. Image reproducing stations 14, 16 and 18 use black, yellow and magenta colored developer materials respectively. The latent image attracts toner particles from the carrier granules of the developer material to form a toner powder image on the photoconductive surface of drum 22. After development of the latent image with cyan toner, drum 22 continues to move in direction of arrow 23 to advance the cyan toner image to a transfer zone 32 where the cyan toner image is transferred from drum 22 to intermediate belt 10 by an intermediate transfer device such as a biased transfer roll 24.

At transfer zone 32, the developed powder image is transferred from photoconductive drum 22 to intermediate belt 10. Belt 10 and drum 22 have substantially the same tangential velocity in the transfer zone 32. Belt 10 is electrically biased to a potential of sufficient magnitude and polarity by biased transfer roll 24 to attract the developed powder image thereto from drum 22. Preferably, belt 10 is made from a conductive substrate with an appropriate dielectric coating such as a metalized polyester film.

After the cyan toner image is transferred to the belt 10 at reproducing station 20, belt 10 advances the cyan toner image to the transfer zone of reproducing station 18 where a magenta toner image is transferred to belt 10, in superimposed registration with the cyan toner image previously transferred to belt 10. After the magenta toner image is transferred to belt 10, belt 10 advances the transferred toner images to reproducing station 16 where the yellow toner image is transferred to belt 10 in superimposed registration with the previously transferred toner images. Finally, belt 10 advances the transferred toner images to reproducing station 14 where the black toner image is transferred thereto in superimposed registration with the previously transferred toner images. After all of the toner images have been transferred to belt 10 in superimposed registration with one another to form a multicolor toner image, the multicolor toner image is transferred to a sheet of support material, e.g., a copy paper at the transfer station.

At the transfer station, a copy sheet is moved into contact with the multicolor toner image on belt 10. The copy sheet is advanced to transfer station from a stack of sheets 34 mounted on a tray 36 by a sheet feeder 38 or from either a stack of sheets 40 on tray 42 or a stack of sheets 44 on a tray 46 by either sheet feed 48 or sheet feeder 50. The copy sheet is advanced into contact with the multicolor image on belt 10 beneath corona generating unit 52 at the transfer station. Corona generating unit 52 sprays charged particles, such as ions or electrons, on to the back side of the sheet to attract the multicolor image to the front side thereof from belt 10. After transfer, the copy sheet passes under a second corona generating unit 53 for detack and continues to move in the direction of arrow 54 to a fusing station. The fusing station includes a fuser assembly generally indicated by the reference numeral 56, which permanently affixes the transferred toner image to the copy sheet. Preferably, fuser assembly 56 includes a heated fuser roll 58 and a backup roller 60 with the toner image on the copy sheet contacting fuser roller 58. In this manner, the toner image is permanently affixed to the copy sheet. After fusing, the copy sheets are then fed either to an output tray 62 or to a finishing station, which may include a stapler or binding mechanism.

Referring once again to reproducing station 20, invariably, after the toner image is transferred from drum 22 to belt 10, some residual particles remain adhering thereto. These residual particles are removed from the drum surface 22 at the cleaning station 27. Cleaning station includes a rotatably mounted fibrous or electrostatic brush in contact with the photoconductive surface of drum 22. The particles are cleaned from the drum 22 by rotation of the brush in contact therewith.

Belt 10 is cleaned in a like manner after transfer of the multicolor image to the copy sheet. Subsequent to cleaning, a discharge lamp (not shown) floods the photoconductive surface of drum 22 to dissipate any residual electrostatic charge remaining thereon prior to the charging thereof for the next successive imaging cycle.

It is believed that the foregoing description is sufficient for the purposes of the present application to illustrate the general operation of a tandem printing machine.

Turning now to FIG. 1, there is illustrated a partial sectional plan view of the compliant belt edge guide of the present invention. The belt 10 is supported on roll 11. The roll 11 is supported by a shaft 13 and bearing 92. There is a fixed stator portion 90 supporting the bearing 92. The edge guide 94 contacts the belt and is biased against the edge of the belt by a spring 96. As the belt rotates around the roll 11, the edge guide 94 remains stationary with respect to the process direction of the belt 10. Waviness in the edge of the belt is absorbed by the edge guide 94 through the spring biasing member 96 which allows the edge guide 94 to move in the direction of arrows A.

For effective guiding and registration results, the axial stiffness of the edge guide should be lower than the belt stiffness felt by a fixed edge guide in laterally displacing the belt. The ratio of these stiffnesses is a good approximation to the reduction in lateral belt motion.

An example of implementation of a compliant edge guide is given in FIG. 1.

There is also a lower limit to the edge guide stiffness and it is set by two major considerations. The first is dictated by the maximum allowable uncertainty in the mean lateral position of the belt from module to module. The second is dictated by a need to limit the lateral belt motion due to disturbances other than the lack of straightness of the belt edge.

In belt modules where most of the lateral belt walk is caused by lack of straightness of the belt edge and where lateral room is available for uncertainty in the belt lateral position, edge guide compliance is an effective and reasonably inexpensive method of decreasing lateral belt motion and consequent color misregistration.

As an added benefit, the peak values of the edge force which are due to belt and module elasticity (as opposed to lateral slip of the belt on the rolls) will decrease to a value close to the average.

Photoreceptor and intermediate belts exhibit edge waviness due to errors in their manufacturing process. The total amplitude of this waviness is on the order of 0.5 mm although much lower values have been obtained at some additional cost.

When the high portion of the edge waviness comes to ride on a fixed edge guide, the body of the belt is locally pushed away from the guide an amount equal to the waviness itself. If the belt is stiff and the axial stiffness of the other rolls in the system is low, the entire belt shifts parallel to itself. If the belt is soft and the axial stiffness of the other rolls is high, the belt is deformed and changes its alignment with the other rolls causing a walking conditions which tends to bring the belt in a shifted configuration similar to the initial one.

After the maximum of the edge waviness the belt keeps contact with the guide by walking toward it as long as the receding slope of the edge remains smaller than the natural walk rate of the free belt. If the slope of the edge ever exceeds the natural walk rate of the belt, the belt will separate from the guide and walk at a steady rate until contact is made again at some point on the rising slope of the edge. The process is then repeated for each belt revolution.

Therefore, the amplitude of the lateral belt motion is somewhat smaller than the edge waviness amplitude and, generally, it is different at different points in the belt loop. The situation can be somewhat optimized by a) designing the edge guide support roll so that it is laterally very soft,
b) designing the rolls at the other end of the loop as laterally stiff as possible consistently with the maximum edge force which the belt can support,
c) making the belt loop so that its rolls are as aligned as possible in order to minimize the walk rate,
d) minimizing belt conicity,
e) making belt edges as straight as possible.

In many cases these measures are not sufficient. Replacing the rigid edge guide with a compliant one can alleviate the registration consequences of belt edge waviness at the expense of some complication and a somewhat increased belt and module width.

Typically, the walk rate of a belt due to an edge force is proportional to the force itself for any particular belt module configuration. This relation must be established for the belt module of interest. This can be accomplished experimentally or by using a belt guidance computer model or both.

The walk rate variation induced by the compliant edge guide through one belt revolution is proportional to the force variation produced by the edge guide stiffness multiplied by the waviness amplitude. Thus:

$$w_R = wkA/F$$

or $$k: Fw_R/(wA)$$

where:

$w_R$=maximum walk rate due to edge waviness
w=walk rate due to edge force F
F=edge force
A=edge waviness amplitude
k=edge guide stiffness As an example of a value of compliance which would achieve an acceptable walk rate, let us consider the following case:

An acceptable registration target might be to not vary the lateral walk rate by more than what would produce a 10 micron lateral shift in 500 mm of travel. This results in $w_R = 0.010/500 = 0.00002$ A maximum acceptable value of edge force is, typically

F=10N a typical maximum walk rate for all combinations of conicities and misalignment could be w=0.00015 mm/mm A typical total edge waviness amplitude is A=0.5 mm Then the above equations indicate that the required stiffness is less than k=2.67N/mm.

The above numbers indicate that the 10N of maximum mean edge force would require nearly 4 mm of belt displacement on each side of the machine. This would increase the size of the belt and the size of the module by 8 mm. This might be unacceptable and some compromise and optimizations might be necessary. In any event, careful design and calculations for the actual case of interest should be performed.

A careful tolerance analysis of the walk rate—maximum edge force relationship should be conducted using a suitable belt guidance simulation program coupled with experimentation to decrease the maximum walk rate by proper design of the lateral compliance of the rolls and provisions for their alignment.

In recapitulation, there is provided an apparatus for guiding a moving belt, particularly in an electrophotographic printing machine of the type having an endless photoreceptor belt supported by a plurality of rolls and arranged to move in a predetermined path through a plurality of processing stations disposed therealong the belt being of the type which is supported by a plurality of rolls. A compliant belt guide is positioned at each end of a tensioning roll. The guide is biased so as to absorb a portion of the force exerted on it by the moving belt but to maintain a minimal belt walk in a direction transverse to the predetermined path.

It is, therefore, apparent that there has been provided in accordance with the present invention, a compliant belt guide system for an endless belt loop that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for controlling a web moving along a predetermined path comprising:

a non-pivoting member rotatably supporting the web;

an edge guide adjacent one end of said support member, said edge guide positioned to contact an edge of the web so as to maintain the web along the predetermined path; and a biasing device for resiliently urging said edge guide into contact with the edge of the web so as to maintain a steering force on the web to maintain the web along the predetermined path, said biasing device absorbing a portion of a force exerted on said edge guide by the web to minimize movement of the web in a direction normal to the predetermined path while minimizing buckling of the web.

2. An apparatus according to claim 1, wherein said support member comprises a rotatable roller supporting the web.

3. An apparatus according to claim 2, further comprising a second edge guide adjacent another end of said roll.

4. An apparatus according to claim 1, wherein said edge guide comprises a slidably mounted, substantially rigid member.

5. An apparatus according to claim 1, wherein said biasing device comprises a spring resiliently urging said edge guide into contact with the edge of the web, said spring absorbing a portion of a force exerted on said edge guide by the web in a direction substantially normal to the predetermined path.

6. An apparatus according to claim 5, wherein said spring exerts on said edge guide a force less than a force required to induce buckling in the edge of the web.

7. An apparatus for controlling a web moving along a predetermined path comprising:

a member rotatably supporting the web, wherein said support member comprises a rotatable roller supporting the web;

an edge guide adjacent one end of said support member, said edge guide positioned to contact an edge of the web so as to maintain the web along the predetermined path, wherein said edge guide comprises a slidably mounted, substantially rigid member; and a spring resiliently urging said edge guide into contact with the edge of the web, said spring absorbing a portion of a force exerted on said edge guide by the web in a direction substantially normal to the predetermined path wherein the force exerted by said spring is less than a force required to induce buckling in the edge of the web and is determined by the equation $K=(Fw_R)/(wA)$ wherein, K is the biasing force, F is the edge force exerted by the web, $w_R$ is the maximum walk rate due to edge waviness, w is the walk rate of the web due to edge force F, and A is the web edge waviness amplitude.

8. An electrophotographic printing machine of the type having an endless photoreceptor belt supported by a plurality of rolls and arranged to move in a predetermined path through a plurality of processing stations disposed therealong, including:

a non-pivoting member rotatably supporting the belt;

an edge guide adjacent one end of said support member, said edge guide positioned to contact an edge of the belt so as to maintain the belt along the predetermined path; and a biasing device for resiliently urging said edge guide into contact with the edge of the belt so as to maintain a steering force on the belt to maintain the belt along the predetermined path, said biasing device absorbing a portion of a force exerted on said edge guide by the belt to minimize movement of the belt in a direction normal to the predetermined path while minimizing buckling of the belt.

9. A printing machine according to claim 8, wherein said support member comprises a rotatable roller supporting the belt.

10. An apparatus according to claim 9, further comprising a second edge guide adjacent another end of said roll.

11. An apparatus according to claim 8, wherein said edge guide comprises a slidably mounted, substantially rigid member.

12. An apparatus according to claim 8, wherein said biasing device comprises a spring resiliently urging said edge guide into contact with the edge of the belt, said spring absorbing a portion of a force exerted on said edge guide by the belt in a direction substantially normal to the predetermined path.

13. An apparatus according to claim 12, wherein said spring exerts on said edge guide a force less than a force required to induce buckling in the edge of the belt.

14. An electrophotographic printing machine of the type having an endless photoreceptor belt supported by a plurality of rolls and arranged to move in a predetermined path through a plurality of processing stations disposed therealong, including:

a member rotatably supporting the web, wherein said support member comprises a rotatable roller supporting the web;

an edge guide adjacent one end of said support member, said edge guide positioned to contact an edge of the web so as to maintain the web along the predetermined path, wherein said edge guide comprises a slidably mounted, substantially rigid member; and a spring resiliently urging said edge guide into contact with the edge of the web, said spring absorbing a portion of a force exerted on said edge guide by the web in a direction substantially normal to the predetermined path, wherein the biasing force of said spring is less than a force required to induce buckling in the edge of the web and is determined by the equation $K=(Fw_R)/(wA)$, wherein K is the biasing force, F is the edge force exerted by the belt, $w_R$ is the maximum walk rate due to edge waviness, w is the walk rate of the belt due to edge force F, and A is the edge waviness amplitude.

* * * * *